US007735418B2

(12) United States Patent
Hoffmann et al.

(10) Patent No.: US 7,735,418 B2
(45) Date of Patent: Jun. 15, 2010

(54) PRINTING UNIT PERTAINING TO A MULTI-COLOR ROLLER ROTARY PRESS, AND METHOD FOR OPERATING THE SAME

(75) Inventors: Thomas Heinrich Hoffmann, Würzburg (DE); Jürgen Alfred Stiel, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 348 days.

(21) Appl. No.: 11/587,953

(22) PCT Filed: Apr. 28, 2004

(86) PCT No.: PCT/EP2004/050632

§ 371 (c)(1),
(2), (4) Date: Oct. 27, 2006

(87) PCT Pub. No.: WO2005/115756

PCT Pub. Date: Dec. 8, 2005

(65) Prior Publication Data

US 2008/0000366 A1 Jan. 3, 2008

(51) Int. Cl.
*B41F 5/18* (2006.01)
*B41F 5/04* (2006.01)

(52) U.S. Cl. ..... 101/180; 101/183; 101/221

(58) Field of Classification Search ..... 101/180, 101/183, 184, 216, 217, 335, 221
See application file for complete search history.

(56) References Cited

U.S. PATENT DOCUMENTS 2,859,691 A 11/1958 Heller
4,955,299 A 9/1990 Ohta
5,025,726 A * 6/1991 Funabashi et al. ..... 101/352.05
5,282,417 A 2/1994 Germann
5,315,930 A * 5/1994 Niemiro ..... 101/366
5,692,439 A * 12/1997 Wech ..... 101/220
5,782,182 A 7/1998 Ruckmann et al.
5,878,666 A * 3/1999 Schneider et al. ..... 101/217
6,634,292 B2 * 10/2003 Fujiwara et al. ..... 101/141

(Continued)

FOREIGN PATENT DOCUMENTS

EP 1 149 694 A1 10/2001

(Continued)

*Primary Examiner*—Ren Yan
*Assistant Examiner*—David Banh
(74) *Attorney, Agent, or Firm*—Jones, Tullar & Cooper, P.C.

(57) ABSTRACT

A printing unit, which is a part of a multi-color printing press, has a plurality of double printing units which are arranged vertically one above the other and consist of two printing groups forming a double print position. The printing group cylinders are mounted together in a central stand section. Inking units, which are associated with the printing groups, are mounted in outer stand sections. A distance between adjacent ones of these stand sections is adjustable. Printing and transfer cylinders of each printing group are coupled by a toothed gear wheel connection and are driven in pairs by a separate drive motor. The toothed gear wheels of all of the printing group cylinders are arranged in a common lubricant chamber which is formed by the central stand section and a cover. The inking systems have at least one separate drive motor, which is independent of the printing group cylinders.

24 Claims, 4 Drawing Sheets

U.S. PATENT DOCUMENTS

| | | | | |
|---|---|---|---|---|
| 7,475,634 | B2 * | 1/2009 | Barrois et al. | 101/349.1 |
| 2001/0035104 | A1 * | 11/2001 | Gottling et al. | 101/248 |
| 2001/0037737 | A1 * | 11/2001 | Koppelkamm et al. | 101/147 |
| 2002/0096071 | A1 * | 7/2002 | Junghans et al. | 101/350.3 |
| 2002/0185025 | A1 | 12/2002 | Dufour et al. | |
| 2003/0205154 | A1 * | 11/2003 | Chou et al. | 101/349.1 |
| 2004/0020383 | A1 * | 2/2004 | Stiel | 101/180 |
| 2004/0074406 | A1 * | 4/2004 | Gerner et al. | 101/216 |
| 2004/0089177 | A1 * | 5/2004 | Stiel | 101/218 |
| 2004/0107849 | A1 | 6/2004 | Christel et al. | |
| 2004/0144268 | A1 | 7/2004 | Christel et al. | |
| 2004/0231535 | A1 * | 11/2004 | Gerner et al. | 101/217 |
| 2005/0034615 | A1 | 2/2005 | Holm et al. | |
| 2007/0181021 | A1 * | 8/2007 | Christel et al. | 101/218 |

FOREIGN PATENT DOCUMENTS

| | | | |
|---|---|---|---|
| EP | 1 264 686 | A1 | 12/2002 |
| WO | WO 95/24314 | | 3/1995 |
| WO | WO 02/81219 | A2 | 4/2002 |
| WO | PCT/DE02/01266 | * | 10/2002 |
| WO | WO02076741 | * | 10/2002 |

* cited by examiner

PRINTING UNIT PERTAINING TO A MULTI-COLOR ROLLER ROTARY PRESS, AND METHOD FOR OPERATING THE SAME

CROSS-REFERENCE TO RELATED APPLICATIONS

This patent application is the U.S. national phase, under 35 USC 371, of PCT/EP2004/050623, filed Apr. 28, 2004 and published as WO 2005/115756 A1, the disclosures of which are expressly incorporated herein by reference.

FIELD OF THE INVENTION

The present invention is directed to a printing unit for a multicolor web-fed rotary printing press and to a method for operating such a printing unit. A plurality of blanket-to-blanket printing units are arranged vertically one above the other. Each printing unit includes two printing groups which form a blanket-to-blanket location. The printing group cylinders are all mounted in a center frame section. Inking units are mounted in outer frame sections.

BACKGROUND OF THE INVENTION

A printing unit of this general type is discussed in WO 95/24314 A1. Four blanket-to-blanket printing units are arranged vertically, one above another, and can be moved horizontally relative to one another in the area of their blanket-to-blanket printing point. The blanket-to-blanket printing units that are on the same side of a web are each mounted in a shared frame. At least one of said frames can be moved horizontally.

EP 12 64 686 A1 discloses a printing unit with blanket-to-blanket printing units arranged vertically, one above another The printing group cylinders are mounted in a center frame section and the two inking units are mounted in respective outer frame sections. These outer frame sections can be moved horizontally, relative to the center frame section, in order to introduce plate handling devices into the intermediate space, as may periodically be needed.

EP 11 49 694 A1 discloses a printing unit having a multitude of arch-shaped blanket-to-blanket printing units, arranged vertically, one above another. Each such printing unit is comprised of two printing groups that form a blanket-to-blanket printing point. The printing group cylinders of the printing groups are all mounted in a center frame section while the inking units, which are assigned to the printing groups, are mounted in respective outer frame sections. The adjacent frame sections are structured such that their spacing relative to one another is adjustable.

SUMMARY OF THE INVENTION

The object of the present invention is to provide a printing unit for a multicolor web-fed rotary printing press, and to provide methods for operating such a printing press.

The object is attained, in accordance with the present invention with the provision of a printing unit for a multicolor web-fed rotary printing press having a plurality of blanket-to-blanket printing units which are arranged vertically. Each of these printing units is comprised of two printing groups that form a blanket-to-blanket printing location. The printing group cylinders of the printing units are all mounted in a center frame section. Inking units that are assigned to the printing groups are each mounted in outer frame sections. The adjacent frame sections can be adjusted, in terms of their spacing, with respect to each other. Forme and transfer cylinders of each printing group are coupled via a toothed gear connection and are actuated in pairs by their own drive motor. The inking units each have at least one separate drive motor mounted on its assigned outer frame section.

The benefits to be achieved with the present invention consist especially in that in a first aspect, high printing quality is ensured at low cost using a rotary printing press having a compact construction. This is achieved, firstly, in that the printing group cylinders can remain in a fixed, such as, for example, a preset position relative to one another, even when the printing unit is opened, thus insuring excellent reproducibility. Secondly, the quality (doubling) is increased because a plane of connection for the rotational axes of the coordinating transfer cylinders forms an angle that is not equal to 90°, and which is preferably between 77 and 87°, with the plane of the web that is being fed into the respective blanket-to-blanket printing unit. Further, by using finite rubber blankets, which are structured as multipart printing blankets, a rigid mounting of the printing group cylinders in the frame walls can be effected, thereby providing rigidity to the printing press.

This configuration is supported or is made possible by a drive configuration that is specifically adapted to it. To prevent a drive train from extending beyond the point of separation between the printing group cylinders and the inking unit, each blanket-to-blanket printing unit is rotationally actuated by at least one drive motor of its own. This at least one drive motor for each blanket-to-blanket printing unit is independent from the other blanket-to-blanket printing units, and is also independent from the assigned inking units. Each inking unit also has its own independent drive motor for its rotational actuation. Transmission play, in the area of a separable transmission, and a transfer of impacts up to the printing point via the drive train, and resulting from reversal movements in the inking unit, are prevented. In one advantageous embodiment of the present invention, the printing group cylinders can each be separately driven by respective, independent drive motors. However, in order to minimize cost while achieving high quality and variability, in the preferred embodiment of the present invention, coordinating forme cylinders and transfer cylinders are actuated, in pairs, by drive motors that are independent from the motors of other pairs of forme cylinders and transfer cylinders. In this manner, a printing forme change for each individual printing point, using the drive motor that actuates the pair of cylinders, both during print operation and during maintenance and, if applicable, with longitudinal registration, is still possible. In this context, the frame section that accommodates all the printing group cylinders is also advantageous with respect to its simple construction. In this construction, a shared lubricant chamber can be formed for all of the drive trains of the various printing groups.

Of particular advantage, with respect to quality and a compact construction, is the structuring of the printing groups or inking units as printing groups or inking units which are suitable for "waterless offset printing". No dampening agent supply or dampening unit is provided. Instead, the inks and the printing formes are selected to have corresponding properties suitable for such waterless offset printing.

BRIEF DESCRIPTION OF THE DRAWINGS

Preferred embodiments of the present invention are represented in the accompanying drawings and will be described in greater detail below.

The drawings show.

DESCRIPTION OF THE PREFERRED EMBODIMENTS

Figure 1:
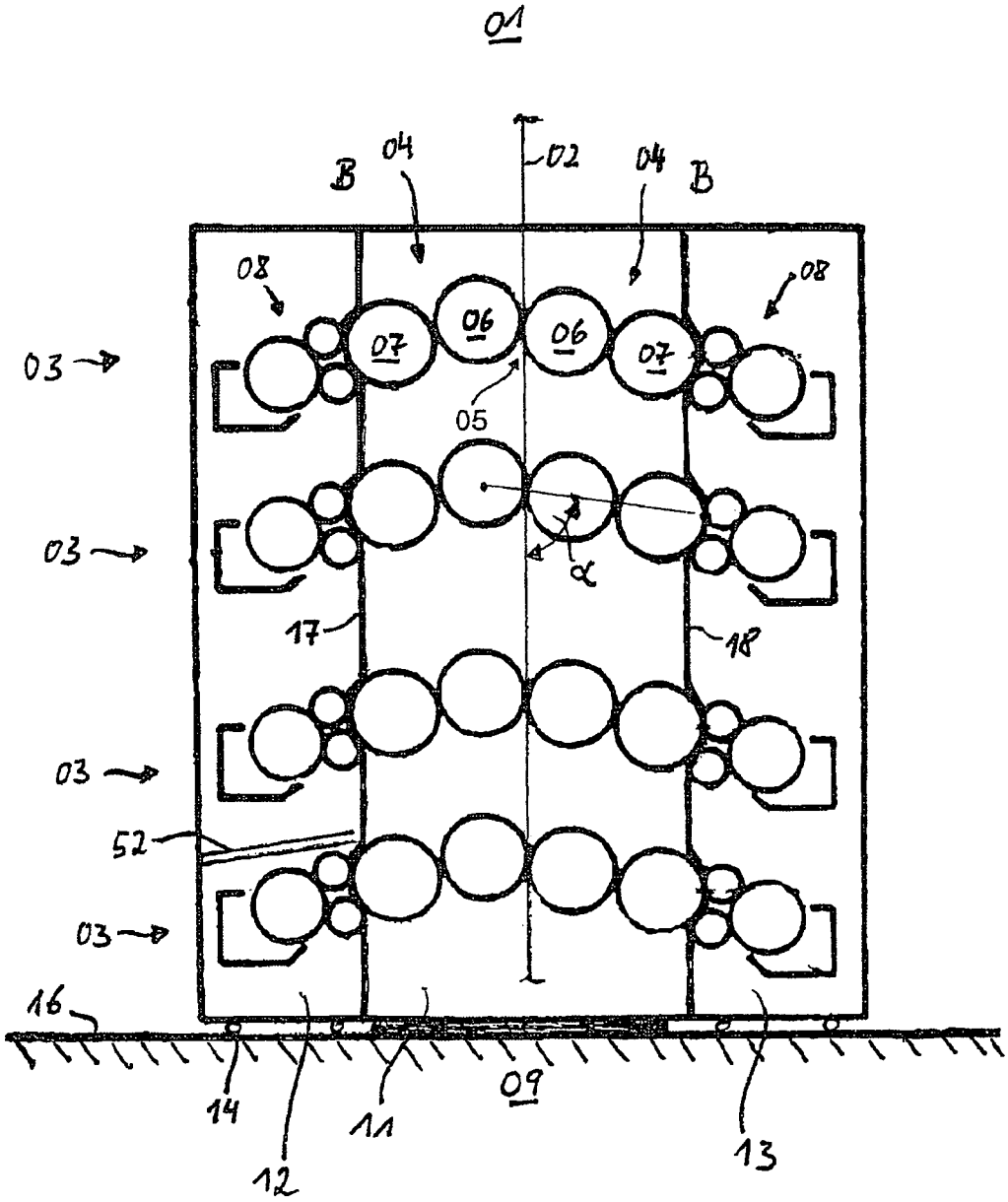
FIG. 1 a schematic side elevation view of a printing unit in an operational position B.

Referring initially primarily to FIG. 1, a printing machine, such as, for example, a web-fed rotary printing press, and especially a multicolor web-fed rotary printing press, has a printing unit 01, in which a web of material 02, referred to here as web 02, can be printed multiple times in sequence, such as, for example, in this case the web 02 can be printed four times. Alternatively, multiple webs can be printed simultaneously a single time or multiple times. The printing unit 01 has multiple blanket-to-blanket printing units 03 arranged vertically, one above another with four such printing units 03 being depicted in FIG. 1, and which printing units 03 are operable, for double-sided printing in blanket-to-blanket operation. The blanket-to-blanket printing units 03 are each formed by two printing groups 04, each of which printing groups 04 has cylinders 06; 07. One cylinder is structured as a transfer cylinder 06 and one cylinder is structured as a forme cylinder 07, as depicted by for example, printing group cylinders 06; 07, and an inking unit 08. In each case, a blanket-to-blanket printing point 05 is formed between the two transfer cylinders 06 when these two cylinders, in the engaged position depicted in FIG. 1. The above-described components are indicated with lead lines and only in the uppermost blanket-to-blanket printing unit 03 shown in FIG. 1. However, the several printing units 03; 04, which are arranged one above another, are essentially identical in structure, especially in the embodiment of the features that are relevant to the present invention.

The forme cylinders and transfer cylinders 07; 06 are preferably each structured with a barrel width of at least four vertical printed pages arranged side by side in newspaper format, and especially in broadsheet format. In this manner, a double-width web 02 can be printed with four pages positioned side by side. The forme cylinder 07 can be correspondingly loaded with four printing formes arranged side by side. Advantageously, both of the cylinders 06; 07 have a circumference that corresponds essentially to two printed pages in newspaper format, and which are arranged in tandem.

The printing group cylinders 06; 07 of the multiple, such as the depicted four blanket-to-blanket printing units 03, which are arranged one above another, are rotatably mounted in a center frame or panel section 11, which is, in turn, preferably arranged fixed in its location such as, for example, being secured in plate on a floor 09 of the printing shop, on a stationary support 09, on a mounting plate 09 or on a mounting frame 09 for the printing unit 01. The inking units 08, which are situated on both sides of the blanket-to-blanket printing units 03, as may also be seen in FIG. 1, are each mounted in separate frame or panel sections 12; 13, which are, in turn, mounted vertically opposite the center frame section 11. The frame or panel sections 12, 13 are movable relative to the floor 09 or the support 09 or the mounting plate 09 or the mounting frame 09, which is hereinafter referred to as the support 09. For this purpose, the outer frame sections 12; 13 are each mounted in bearing elements 14; 16 of the frame sections 12; 13 and of the support 09, which bearing elements 14; 16 correspond with one another. These bearing elements 14; 16 can be structured as rollers 14 that run on rails 16, as illustrated in FIG. 1, or can be configured as sliding or as roller-mounted linear guide elements 14; 16 that are allocated to one another.

Figure 2:
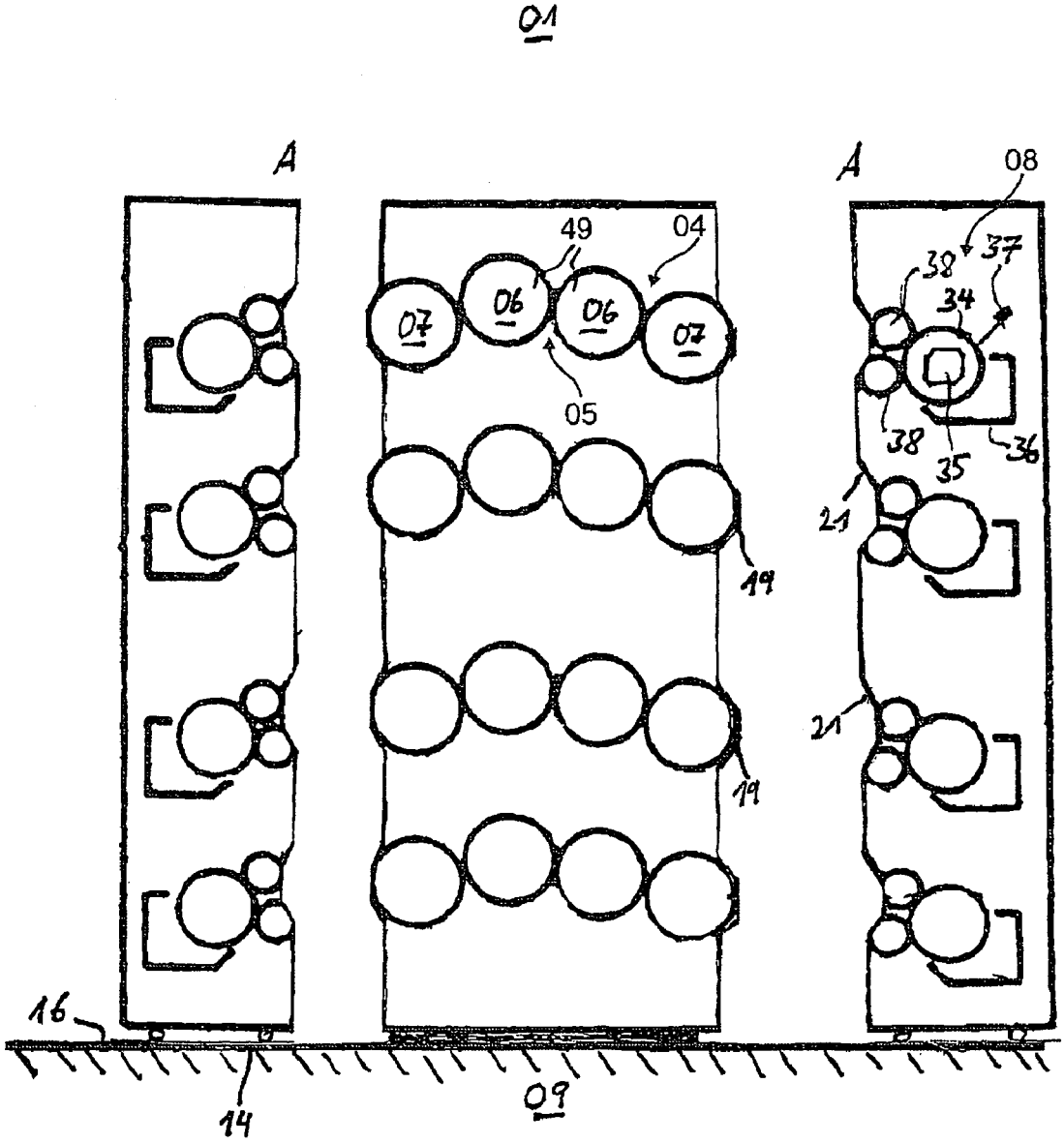
in FIG. 2 a view similar to FIG. 1 and showing the printing unit in a maintenance position A.

Preferably, the fixed central frame or panel section 11, and the movable, outer frame or panel sections 12; 13 are structured such that in their operational position B, as depicted in FIG. 1, they are structured in pairs, the shapes of which pairs essentially complement one another on their facing sides. When these pairs are pushed together, at their lines of separation or their lines of abutment 17; 18 they nevertheless form an essentially closed side configuration, as shown in FIGS. 1 and 2. In this manner, on both the cylinder side and the inking unit side, the greatest possible area for accommodating the bearing can be achieved in the corresponding frame section 11; 12; 13. Additionally, requirements with respect to noise, personnel safety and containment of contamination can be met. In order to achieve the most stable mounting possible, with cylinder journals of corresponding strength, the center frame section 11 deviates from a vertical alignment in the area of the cylinder bearing, which is not specifically shown in FIGS. 1 and 2, and is equipped with corresponding protrusions 19, as is shown in FIG. 2, and that accommodate the bearing. The outer frame sections 12; 13 have recesses 21 whose shape complements these protrusions 19, as may also be seen in FIG. 2. The recesses 21 and the protrusions 19 are formed on the bearing arrangements in the inking unit 08 and the printing group 04 with respect to provision of sufficient or even the greatest possible strength of the enclosure, i.e. at least a minimum strength, through the respective frame.

FIG. 2 shows a maintenance position A of the printing unit in accordance with the present invention on both sides of the printing points 05 The relative position of the inking units 08, with respect to the printing group cylinders 06; 07, is achieved by moving the frame sections 12; 13 that accommodate the inking units 08 laterally. It is also possible to adjust only one side of the assembly to the depicted maintenance position A, while the other side of the printing unit 01 is in the operational position B depicted in FIG. 1. In principle, the relative positions can also be achieved in another embodiment, in which one outer frame section, 12 or 13 is mounted so as to be fixed in space, while the center section 11 and the other outer frame section 11, 13 or 12 or even all three frame sections 11; 12; 13 are mounted so as to be movable with respect to each other.

Figure 4:
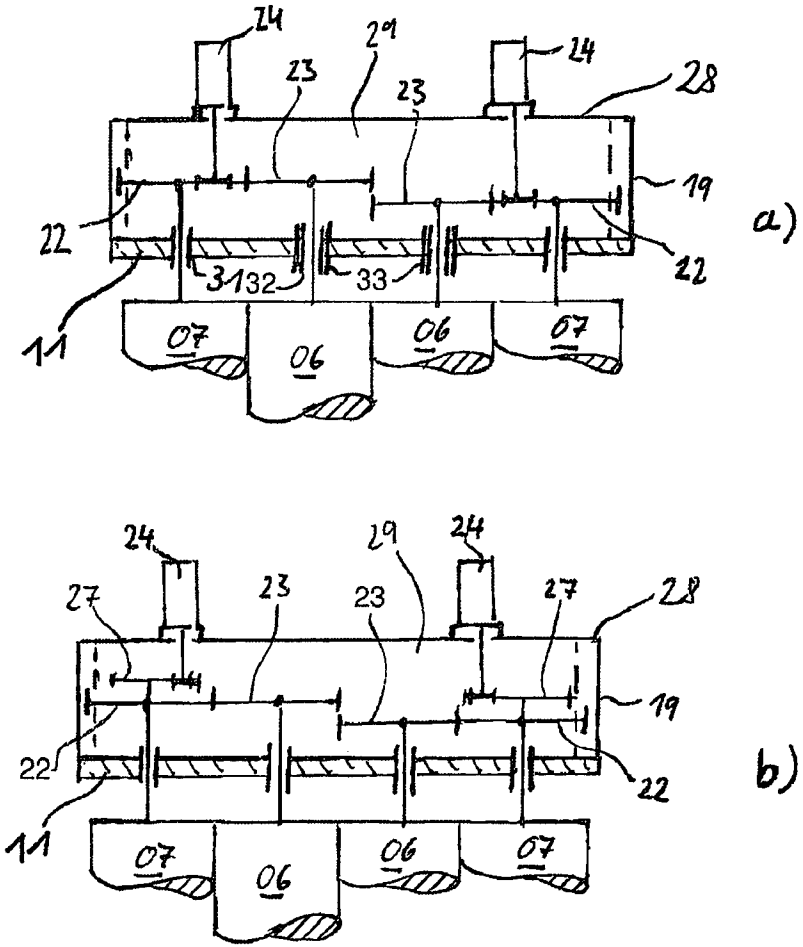
in FIGS. 4*a* and 4*b* top plan views of two drive configurations; and in FIGS. 5*a* and 5*b* two preferred embodiments of the inking unit in accordance with the present invention.
Figure 3:
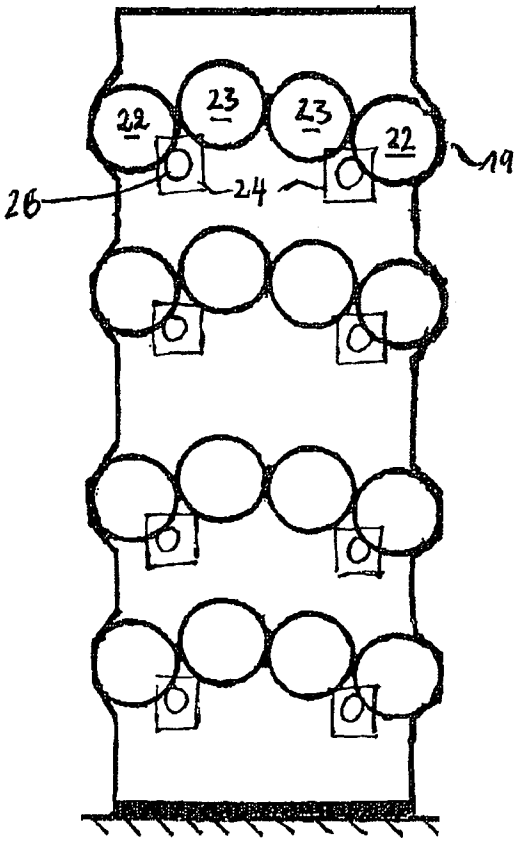
in FIG. 3 a frontal view of a drive configuration in accordance with the present invention.

FIGS. 3 and 4 schematically depict an advantageous drive configuration for the printing group cylinders 06; 07 of the printing unit 01. The journals for the forme cylinders and of the transfer cylinders 07; 06 are each non-rotatably connected, at their end surfaces, to toothed gears 22; 23, respectively, and particularly, spur gears 22; 23. These gears, in pairs, form a drive connection. The paired drive is advantageously accomplished by the use of a drive motor 24 via a transmission, and particularly by a speed-reduction transmission, which is situated on one of the two cylinders 06; 07, and particularly on the forme cylinder 07. Due to its shorter adjustment path, the location of the drive on the forme cylinder 07 contributes to a simple and sturdy construction of the printing unit. In the depicted example, the drive is accomplished via a sprocket wheel 26 on the spur gear 22, as seen in FIG. 4*a*. In another embodiment, as seen in FIG. 4*b*, in addition to the spur gear 22, a second toothed gear 27 can be non-rotatably connected to the forme cylinder journal, and on which second toothed gear 27 the sprocket wheel 26 is actuated. In this embodiment, the spur gears 22; 23, that form the drive connection, can be structured to be evenly toothed to favor the accomplishment an axial relative shiftability to accomplish lateral register, and the second toothed gear 27 and the sprocket gear 26 can be structured to be helically toothed in order to provide rigidity. In principle, it is also possible, with the above-described configurations, to effect the drive first on the transfer cylinder 06 and from there on the forme cylinder 07. Reference symbols 06 and 07 would then need to be transposed. In a preferred embodiment which is not shown here, and for the purpose of improved attenuation, the output from the drive motor 24 to one of the cylinders 06; 07 can take place not via a toothed gear connection, such as a sprocket but instead can take place via a belt and chain drive, such as, for example, via a belt, and especially a toothed belt which meshes with corresponding pulleys. If the drive motor 24 is sufficiently heavy, is large in dimension and/or has an adapter transmission, typically for speed reduction, then the drive motor 24 can also drive coaxially on one of the cylinders 06; 07 of each of the pairs of cylinders.

As may be seen by again referring to FIG. 4, the frame section 11, together with a cover 28, preferably forms a lubricant chamber 29 that conceals the cylinder end surfaces, and also conceals the toothed gears 22; 23; 27; or the sprockets 26. This lubricant chamber 29 preferably extends over the four spur gars 22; 23 of a blanket-to-blanket printing unit 03 in its width, and over all four of the vertically arranged blanket-to-blanket printing units 03 in its height. In other words, one shared lubricant chamber 29 exists for all of the printing group cylinders 06; 07 of the printing unit 01.

The blanket-to-blanket printing units 03 are each structured, relative to the intended vertical web path, such that a plane of connection, which is defined by the rotational axes of the coordinating transfer cylinders 06 of each printing unit 03, in their engaged position, forms an angle $\alpha$ that is not equal to 90°, and which is preferably between 77° and 87°, with respect to the plane of the web 02 that is being fed into the respective blanket-to-blanket printing unit 03, as is shown by way of example in FIG. 1. In the engaged position of each printing unit 03, the rotational axes of the forme cylinders 07 do not lie in the same plane as those of the transfer cylinders 06. In other words, the blanket-to-blanket printing units 03 are not linear in structure. Instead, they are angular and preferably are arch-shaped. To accomplish this purpose, the cylinders 06; 07 are correspondingly mounted in the frame section 11. As is schematically indicated in FIG. 4*a*, by the use of double lines, the journals of the transfer cylinder 06 are mounted in radial bearings 32, which radial bearings 32 are, in turn, mounted in eccentric bushings 33 to thereby allow adjustment of the transfer cylinder 06. This mounting can have a overall structure, such as, for example, a three-ring or as a four-ring bearing 32, 33. In one preferred embodiment, only one of the transfer cylinders 06 is mounted in this manner, so as to be adjustable, while the other transfer cylinder 06 is fixed. The mounting of the forme cylinders 07 can also be structured in this manner. However, in FIG. 4*a* only the radial bearings 31 are shown.

In one preferred embodiment of the present invention, the printing unit 01 is structured as a printing unit 01 for use in dry offset printing, or in other words for waterless or for dampening agent-free offset printing. In this preferred embodiment, the printing unit 01 has no dampening units, and thus is even more compact. In FIG. 1, the inking units 08 are illustrated in schematic fashion, and can be structured differently in accordance with the demands of the specific printing unit.

In a first embodiment of the present invention, and which is particularly advantageous in terms of its compact construction, the inking units 08 are structured as short inking units 08, as seen at the top right of FIG. 2. Such short inking units 08 each have an anilox roller 34, which dips into an ink tray 36 where it absorbs ink. Excess ink is scraped off the anilox roller 34 by a blade device 37, such as, for example, by a fountain blade or a fountain sheet. The ink tray 36 and the blade device 37 can preferably be structured as a single component as an ink chamber blade 36, 37, which receives its ink from an ink supply by the operation a pump that is not shown in FIG. 2. The anilox roller 34 preferably has a drive motor 35 that is mechanically independent from the printing group cylinders 06; 07. The ink is taken from the anilox roller 34 by at least one forme roller 38, and advantageously by two such rollers 38, as seen in FIG. 2 or by even three such forme rollers 38, and is transferred to the forme cylinder 07. Because the cells on the anilox roller 34 essentially define the quantity of ink to be taken up, for each rotation of the anilox roller 34 the overall quantity of ink removed from the ink tray 36 can result either from a relative speed of two rollers or advantageously from the temperature of the ink and/or the temperature of ink-transporting components, such as, for example, the temperature of at least the anilox roller 34. The anilox roller 34 is rotationally actuated by its own drive motor 35, which motor 35 is mechanically independent from the printing group cylinders 06; 07, and especially from the forme rollers 38. With a substantial change in the quantity of ink needed, the anilox roller 34 must, if applicable, be exchanged for another.

In one embodiment of the present invention, that is advantageous in terms of the variability of the quantity of ink, the inking units 08 are structured according to the depictions of FIGS. 5*a* and 5*b*, for example, as roller inking units 08. The ink is again applied by multiple forme rollers 38, such as the two forme rollers 38 depicted in FIGS. 5*a* and 5*b*, to the printing forme of the forme cylinder 07. However, in this embodiment the forme rollers 38 do not receive the ink from an anilox roller 34, but instead receive ink by way of a roller train, which has at least one oscillating cylinder 39 that is provided with a hard surface, and is a so-called distribution cylinder 39. A roller train that has two distribution cylinders 39 with hard surfaces and with one intermediate roller 41 between them, and which is provided with a soft surface, is advantageous. The distribution cylinder 39 that is distant from the forme cylinder receives the ink, through another intermediate roller 41, from a film roller 42 which has a hard surface. In accordance with the partitionable printing unit 01 of the present invention, it is provided that the two distribution cylinders 39 are mechanically coupled to one another via a transmission, such as, for example, a wheel train or a belt and chain drive, and are rotationally actuated by a shared drive motor 43 that is mechanically independent from the printing group cylinders 06; 07. Such a drive train is indicated by a dashed line. In one simple embodiment of the present invention, an oscillating axial movement of the two distribution cylinders 39 can be accomplished, from the rotational movement of the two distribution cylinders 39 by the provision of a corresponding transmission which is not specifically shown. However, in one advantageous embodiment of the present invention, the axial movement of the distribution cylinders 39 is produced by the use of at least one other drive motor that is not shown here. The intermediate rollers 41, and the forme rollers 41 are preferably driven only by friction. The film roller 42 receives ink from a fountain roller 44, with which it forms a contact gap or point. The fountain roller 44 is rotationally actuated via its own drive motor 46. The metering of the ink onto the fountain roller 44 can be accomplished in various ways which are not specifically depicted.

In one simple embodiment of the present invention, as seen in FIG. 5*a*, the fountain roller is configured as a dipping roller 44, which roller 44 dips into the ink reservoir of an ink tray 47. With proper control of the speed of the drive motor 46, and hence the speed of the fountain roller 44, the quantity of ink to be transported from the fountain roller, through the gap, to the film roller 42, can be adjusted.

In one advantageous embodiment of the present invention, as shown in FIG. 5*b*, the inking unit 08 is structured as an ink injector system 08 and receives the necessary quantity of ink in a controlled manner through the use of a pump device 48, which allows a quantity of ink to be applied to the fountain roller 44 in a targeted fashion through the use one or more pumps. Advantageously, the quantity of ink to be applied can be controlled, in zones, for sections of the fountain roller 44, which fountain roller 44 is divided in an axial direction, which quantity of ink applied to the various zones is achieved with multiple pumps or with multiple, individually controllable valves, or preferably with a combination of the two. In this manner, an ink requirement that differs over a web to be printed can be taken into consideration. The pump or pumps 48 can be structured as piston pumps or as continuously running gear pumps.

Figure 5:
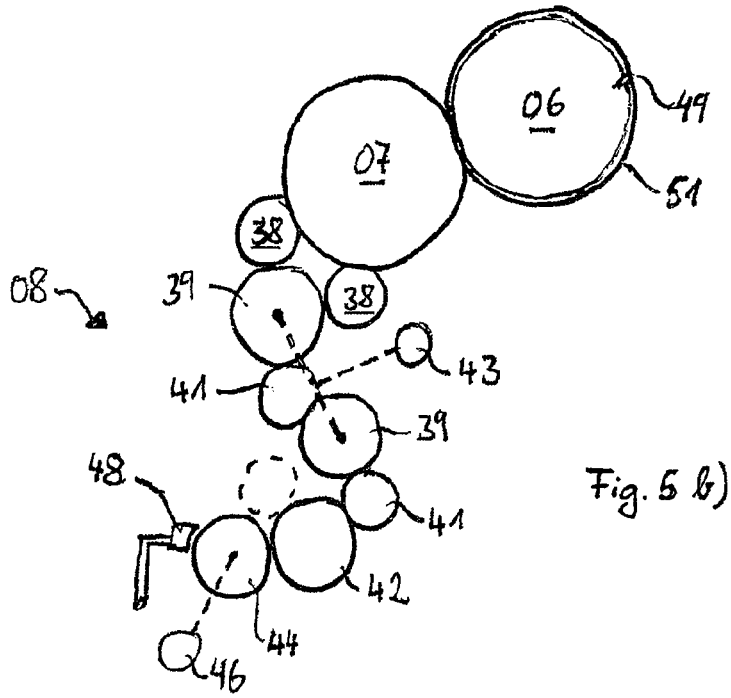
Figure 5:
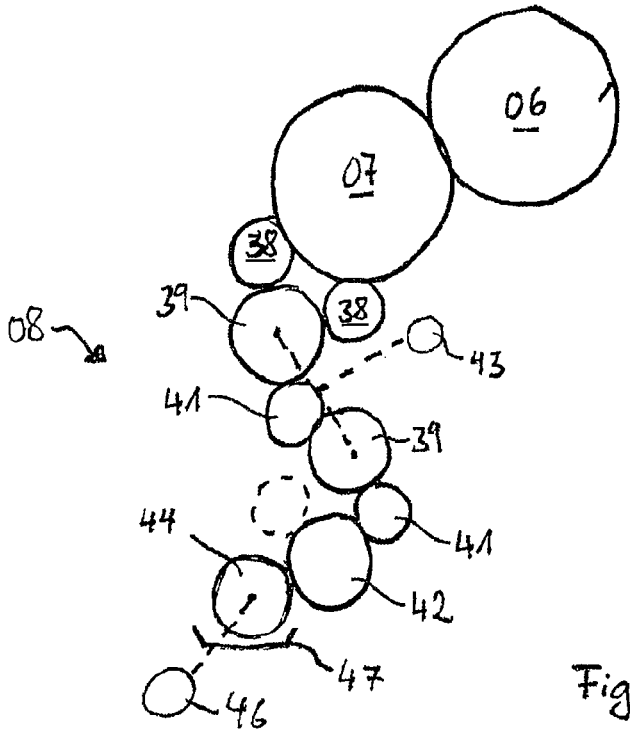

As indicated primarily in FIG. 5, the transfer cylinders 06 each preferably have at least one axially extending opening 49 on their periphery, and especially have a channeled opening 49, into which the ends of a resilient dressing or packing 51, which is schematically depicted in FIG. 5*b*, can be inserted and which, if applicable, can be fastened in an interior channel. The resilient dressing or packing 51 is advantageously structured as a multipart printing blanket 51 which includes a dimensionally stable base plate, such as, for example, of metal and an elastic layer, such as, for example, of rubber, and which thus may be, for example, a so-called metal printing blanket 51. Preferably, on the transfer cylinder 06, which has the width of four printed pages, two such printing blankets 51 are arranged axially side by side. In an advantageous further development, these two axially arranged printing blankets 51 are arranged offset in a circumferential direction with respect to each other, such as, for example offset by 180°. In this manner, and in contrast to rubber sleeves, an exchange of the resilient dressing or packing 51 is possible, without requiring an opening in the panel 11 and without the requirement of corresponding removable radial bearings, also in the panel section 11. In the operational position B depicted in FIG. 1, the resilient dressing or packing 51 can be conveniently exchanged from the intermediate space that is formed between the inking units 08 and the printing group cylinders 06; 07. The same applies to accessing a web 02 in the event of problems during threading of the web 02 or following a web tear.

Although it is advantageous for the maintenance position A of the printing unit, as depicted in FIG. 2, to be assumed in the aforementioned circumstances, such a positioning is not advantageous during routine printing forme changes. As is shown in the lower left corner of FIG. 1 as an example for all of the printing groups 04, in an advantageous further development of the present invention all the printing groups 04 are assigned printing forme exchange devices 52 or printing forme handling devices 52. These printing forme exchange devices 52 can advantageously have two guides, on one of which guides the printing forme, and especially the printing plate, can be advanced to the forme cylinder 07, guided between the inking units 08. On the other guide, the printing forme to be removed can be withdrawn from the forme cylinder 07. The guides can also be structured as closed shafts. The printing forme exchange devices 52 or their guides/shafts are connected to the outer frame sections 12; 13 and are moved together with the movement of the inking units 08. For the advancement and the withdrawal of the printing plates, at least one transport element for the printing forme is expediently provided. This at least one transport element has, for example, a drive element, such as, for example, a motor and has an actuated holding element, such as, for example, a frictional surface, a stop, or a suction foot. Thus to accomplish routine printing forme changes, it is not necessary for the printing unit 01 to be placed in its maintenance position A, which would, in turn, require time and, if applicable, would also require an adjustment of settings and a realignment. The printing group cylinders 06; 07, and especially the transfer cylinders 06 that form the printing point 05, can remain in their positions relative to one another.

Preferably, the printing forme handling device 52 is structured for this purpose such that, when viewed in an axial direction of the forme cylinder 07, a printing forme can be handled on four sections side by side. This can be accomplished by using correspondingly wide, continuous guides or shafts and by also using at least four transport elements for the sections, or with four guides/shafts, which are arranged side by side, each of which is provided with assigned transport elements.

Everything which has been discussed in the above-description with respect to cylinders 06; 07 that have been recited as being four printed pages wide and/or printing forme handling devices 52 can be applied accordingly for cylinders 06; 07 which have a width of six printed pages which are arranged axially side by side.

While preferred embodiments of a printing unit for a multicolor web-fed rotary printing press, and a method for operating such a press, in accordance with the present invention, have been set forth fully and completely hereinabove, it will be apparent to one of skill in the art that various changes in, for example, the overall structure of the printing press, the types of webs being printed, and the like could be made without departing from the true spirit and scope of the present invention which is accordingly to be limited only by the appended claims.

What is claimed is:

1. A printing unit for a multicolor web-fed rotary printing press comprising:

a plurality of vertically spaced blanket-to-blanket printing units arranged one above the other, each of said vertically spaced blanket-to-blanket printing units including first and second printing groups which cooperate with each other to form a blanket-to-blanket printing point for each said blanket-to-blanket printing unit, each of said first and second printing groups including at least a first printing group cylinder configured as a forme cylinder and a cooperating second printing group cylinder configured as a blanket cylinder;

a center frame section, all of said printing group cylinders in said plurality of vertically spaced blanket-to-blanket printing units being rotatably mounted in said center frame section, said plurality of blanket-to-blanket printing points of said plurality of blanket-to-blanket printing units being arranged vertically above each other in said center frame section;

a plurality of radial bearings located in said center frame section, each said radial bearing supporting an end journal of a separate one of said printing group cylinders;

a toothed gear on each said end journal of each said printing group cylinder, said toothed gears on each said printing group cylinder in each said printing group forming a toothed gear drive connection;

a drive motor for each said printing group and being in direct gear drive engagement with each said toothed drive connection;

one a shared lubricant chamber on said center frame section and including a cooperating cover, all of said toothed gear drive connections for all of said plurality of blanket-to-blanket printing units being located in said one shared lubricant chamber;

first and second spaced center frame section lines of abutment, said center frame section lines of abutment having a number of vertically spaced pairs of horizontally extending protrusions, each of said blanket-to-blanket printing units being aligned with one of said vertically spaced pairs of horizontally extending protrusions, each of said radial bearings for each one of said forme cylinders in each said blanket-to-blanket printing group being accommodated in, and supported by one of said vertically spaced center frame section protrusions;

an individual inking unit cooperating with said forme cylinder of each of said first and second printing groups in each of said blanket-to-blanket printing units;

first and second outer spaced frame sections cooperating with said center frame section and each being horizontally adjacent one of said first and second sides of said center frame section, each of said inking units being mounted in one of said first and second outer frame sections, adjacent ones of said center frame section and said first and second outer frame sections being horizontally adjustable with respect to their spacing relative to each other;

a first outer frame section line of abutment cooperable with said first center frame section line of abutment and including first vertically spaced, horizontally receding recesses which are shaped and vertically spaced complementarily with said vertically spaced, horizontally extending protrusions on said first center frame section line of abutment;

a second outer frame section line of abutment cooperable with said second center frame section line of abutment and including second vertically spaced, horizontally receding recesses which are shaped and vertically spaced complimentarily with said vertically spaced, horizontally extending protrusions on said second center frame section line of abutment; and at least one separate drive motor for each said inking unit and which is independent of said printing group cylinders, each said inking unit drive motor being on an associated one of said outer frame sections.

2. The printing unit of claim 1 wherein each of said inking units is an injection inking system including at least one controllable ink pump.

3. The printing unit of claim 1 wherein each of said blanket-to-blanket printing units is arch-shaped and further wherein a plane of connection between said printing group cylinders of each said printing units which define said printing point forming an angle of between 77° and 87° with a plane of a web fed into said blanket-to-blanket printing unit.

4. The printing unit of claim 1 further including a printing forme handling device assigned to each said printing group and being located in an adjacent one of said outer frame sections.

5. The printing unit of claim 1 wherein said outer frame sections are each supported for movement in bearing elements.

6. The printing unit of claim 5 wherein said bearing elements are rollers adapted to run on cooperating rails.

7. The printing unit of claim 5 wherein said bearing elements are linear guide elements which are mounted on one of sliding and rolling elements.

8. The printing unit of claim 1 further including a speed-reduction gear set on one of said forme cylinder and said blanket cylinder.

9. The printing unit of claim 1 wherein at least one of said blanket cylinders in each of said blanket-to-blanket printing units is mounted in said radial bearings which are supported in eccentric bushings.

10. The printing unit of claim 9 wherein said radial bearings and eccentric bushings are three-ring bearings.

11. The printing unit of claim 9 wherein said radial bearings and eccentric bushings are four-ring bearings.

12. The printing unit of claim 1 wherein said printing unit is a dry offset printing unit usable for waterless offset printing.

13. The printing unit of claim 1 wherein each said inking unit is a short inking unit.

14. The printing unit of claim 13 wherein each said short inking unit includes a screen roller adapted to dip into ink in an ink tray and an excess ink removal scraper blade usable to remove excess ink from said screen roller.

15. The printing unit of claim 14 wherein said ink tray and said scraper blade are provided as an ink chamber blade.

16. The printing unit of claim 1 wherein each said inking unit is a roller inking unit.

17. The printing unit of claim 16 wherein each said roller inking unit has a plurality of forme rollers and at least one oscillating roller.

18. The printing unit of claim 1 wherein each said inking unit is an ink injector system.

19. The printing unit of claim 18 wherein each said ink injector system includes at least one controllable ink pump usable to supply a quantity of ink to an ink fountain roller of said inking unit.

20. The printing unit of claim 19 wherein said ink fountain roller in each said inking unit is separated axially in zones, said quantity of ink being controlled in each of said zones.

21. The printing unit of claim 20 further including at least one of multiple pumps and multiple valves for said ink zone control.

22. The printing unit of claim 19 wherein said ink pump is a piston pump.

23. The printing unit of claim 19 wherein said ink pump is a continuously running gear pump.

24. The printing unit of claim 1 further including a resilient packing on each said blanket cylinder and including a dimensionally stable support plate and a multipart printing blanket including an elastic layer.

* * * * *